United States Patent [19]

Ciccarelli

[11] 4,371,601

[45] Feb. 1, 1983

[54] POSITIVELY CHARGED DEVELOPER COMPOSITIONS CONTAINING TELOMERIC AMINES

[75] Inventor: Roger N. Ciccarelli, Rochester, N.Y.

[73] Assignee: Xerox Corporation, Stamford, Conn.

[21] Appl. No.: 259,640

[22] Filed: May 1, 1981

[51] Int. Cl.[3] ..... G03G 9/16

[52] U.S. Cl. ..... 430/110; 430/904; 430/115

[58] Field of Search ..... 526/265; 430/110, 115, 430/106, 904

[56] References Cited

U.S. PATENT DOCUMENTS

| | | | |
|---|---|---|---|
| 3,427,258 | 2/1969 | Trease | 252/500 |
| 3,542,681 | 11/1970 | Mutaffis | 430/115 |
| 3,811,880 | 5/1974 | Browning | 430/108 |
| 3,844,966 | 10/1974 | Nelson | 430/115 |
| 3,893,935 | 7/1975 | Jadwin et al. | 252/62.1 |
| 3,944,493 | 3/1976 | Jadwin et al. | 430/110 |
| 3,970,571 | 7/1976 | Olson et al. | 252/62.1 |
| 4,014,856 | 3/1977 | Gilliams et al. | 430/115 |
| 4,021,358 | 5/1977 | Tomono et al. | 430/106 |
| 4,039,331 | 8/1977 | Lee | 526/265 |
| 4,070,186 | 1/1978 | Gibson et al. | 96/1 |
| 4,070,296 | 1/1978 | Gibson et al. | 252/62.1 |
| 4,079,014 | 3/1978 | Burness et al. | 252/62.1 |
| 4,108,802 | 8/1978 | Wright | 526/265 |

OTHER PUBLICATIONS

Xerox copending Appln. U.S.S.N. 911,623, filed 6/1/78; Chin H. Lu, Toners Containing Alkyl Pyridinium Compounds and Their Hydrates.

*Primary Examiner*—John D. Welsh
*Attorney, Agent, or Firm*—E. O. Palazzo

[57] ABSTRACT

This invention relates to a positively charged dry developer composition comprised of resin particles, pigment particles, carrier particles, and a telomeric amine charge enhancing additive of the formula:

$$[A_xB_y]_Z$$

wherein A is a segment that is soluble/dispersible in the resin particles, B is an amine segment, x and y are numbers representing mole fractions of A and B, the sum of x and y being equal to 1, and Z represents the degree of polymerization, wherein there results a telomeric amine having a number average molecular weight of from about 1,000 to about 10,000; and to a method for developing electrostatic latent images utilizing such compositions.

16 Claims, No Drawings

POSITIVELY CHARGED DEVELOPER COMPOSITIONS CONTAINING TELOMERIC AMINES

BACKGROUND OF THE INVENTION

This invention is generally directed to toner and developer compositions, and more specifically, to developer compositions containing as charge enhancing additives telomeric amines. Toner compositions, that is, resin plus colorant and developers, that is, toner compositions containing the telomeric amine charge enhancing additive of the present invention are useful for causing the development of images in electrophotographic systems, particularly wherein the image bearing member or photoreceptor in such systems is charged negatively. In one embodiment of the present invention there is provided toner and developer compositions containing telomeric amine charge enhancing additives, for the purpose of providing a positive charge on the toner composition, while at the same time, increasing the admix charging rate of new uncharged toner particles which are being added to the charged developer composition present in the electrophotographic system.

The electrophotographic process and more specifically, the xerographic process is well known, as documented in several prior art references. In these processes, an electrostatic latent image is developed by applying electroscopic particles or toner to the electrostatic latent image, using, for example, the cascade development method as described in U.S. Pat. No. 3,618,552, magnetic brush development as described in U.S. Pat. Nos. 2,784,063 and 3,251,706, or touchdown development as described in U.S. Pat. No. 3,166,432. In some instances, it may be desirable in such systems to produce a reverse copy of the original, thus, for example, it may be desired to produce a negative copy from a positive original, or a positive copy from a negative original.

In U.S. Pat. No. 3,893,935, there is disclosed the use of certain quaternary ammonium salts as charge control agents for electrostatic toner compositions. According to the disclosure of this patent, certain quaternary ammonium salts when incorporated into toner materials were found to provide a toner composition which exhibited relatively high uniform and stable net toner charge, when mixed with a suitable carrier vehicle. U.S. Pat. No. 4,079,014 contains a similar teaching with the exception that a different charge control agent is used, namely a diazo type compound.

Many of the known developer compositions have a tendency to lose their positive charge over a period of time, and in some instances, the charge enhancing additives used are incompatible with the thermoplastic resin, thus making it difficult to uniformly disperse or dissolve such materials in the toner composition. Also, the charge control agents as described in U.S. Pat. No. 3,893,935 are soluble in water causing them to be leeched to the toner surface by moisture, thereby adversely affecting the machine environment in which they are used, and copy quality.

Some recently introduced commercial electrophotographic machines utilize organic photoconductors instead of inorganic photoconductors such as selenium, the organic photoconductors being charged negatively, in comparison to selenium which is charged positively. Accordingly, toner materials containing a positive charge thereon are needed for causing the proper development of the images contained on the organic photoreceptor surface. While the prior art describes the use of charge control agents for imparting a positive charge to the toner resin, there continues to be a need for new materials which provide a high positive charge intensity to the toner resin, which intensity is maintained at relatively the same level over an extended period of time. Some charge control agents while they initially impart a positive charge to the toner resin may not be capable of maintaining that charge over a long period of time, and further such charge control agents may be incompatible with the development system thereby adversely affecting the quality of the images developed. Also some of the prior art charge control agents are incompatible with the toner resin material which adversely affects the charge inducing properties of the charge control agent.

Accordingly there is a need for toners and developers which can be used in a reversal imaging system, and more specifically, there is a need for positively charged toner materials which, positive charge is substantially high and can be maintained over an extended period of time, thus allowing the production of high quality images, in electrophotographic imaging systems.

SUMMARY OF THE INVENTION

It is an object of this invention to provide toner and developer compositions which overcome the above-noted disadvantages.

It is a further object of the present invention to provide developer compositions which contain toner and carrier particles, with the toner particles being charged positively.

Another object of the present invention is the provision of developer compositions which can be used to render visible electrostatic latent images containing negative charges on the photoreceptor surface, and which compositions will transfer effectively electrostatically from such a photoreceptor surface to plain bond paper without causing blurring or adversely affecting the quality of the image.

A further object of the present invention is to provide charge enhancing materials which are completely compatible with the toner resin, the charge enhancing materials having controlled dispersibility, that is the degree of solubility/dispersibility is selected and controlled as desired.

A further additional object of the present invention is to provide charge enhancing additives which will not migrate or move from the toner particles to the carrier particles in a developer composition thereby adversely affecting the charge relationship involved, and the final charge contained on the toner resin.

These and other objects of the present invention are accomplished by providing a positively charged dry developer composition comprised of resin particles, pigment particles, carrier particles, and a telomeric amine charge enhancing additive of the formula:

$$[A_xB_y]_Z$$

wherein A is a segment that is soluble/dispersible in the resin particles, B is an amine segment, which segments primary purpose is to control the toner charge electrical properties, x and y are numbers representing mole fractions of A and B, the sum of x and y being equal to 1, and Z represents the degree of polymerization which polymerization is controlled and adjusted wherein there results a telomeric amine having a number average molecular weight of from about 1,000, to about 10,000. The positive charges are contained on the toner particles as indicated hereinafter.

A may represent any segment that is compatible with the toner resin, however, illustrative examples of A include conventional vinyl monomers, and in particular, styrene and substituted styrenes, and acrylates such as alkylacrylates including methacrylates.

Illustrative examples of the B segment include for example, conventional amine containing vinyl monomers, and in particular, 2, 3, or 4-vinyl pyridine and substituted vinyl pyridines, and amine acrylates and methacrylates, such as mono and dialkylaminoethylmethacrylates, an example of which is dimethylaminoethylmethacrylate, and the like.

The letters x and y represent numbers, with the provision that the sum of x plus y must be equal to 1. Thus y may represent the number 0.9 and x may represent the number 0.1, or x may represent the number 0.9 and y may represent a number 0.1. The ratio of x to y can for example be 0.75 to 0.25, 0.96 to 0.04, 0.0 to 1.0, 0.90 to 0.10, 0.98 to 0.02, and the like. In one preferred embodiment of the present invention x represents the number 0.9 and y represents the number 0.1.

The telomeric amines of the present invention are prepared by racting the appropriate vinyl monomer, with amine containing vinyl monomers. Accordingly, there can be reacted from about 0.9 moles of a vinyl monomer, such as styrene, with about 0.1 moles of a vinyl pyridine, the reaction being accomplished at a temperature of from about 20 degrees Centigrade to about 100 degrees Centigrade, depending on the initiator selected, followed by separating the product by known methods including filtering and washing. In order to obtain a telomeric amine of a number average molecular weight of from about 1,000, to about 10,000 the degree of polymerization Z is controlled by for example, terminating the polymerization reaction utilizing a chain transfer agent, as described herein. Also, the ratio of X to Y is obtained by adjusting the monomer feed ratios, of the A and B segments described and the reactivity ratios of the A and B segments described herein, thus reacting about 0.90 moles of styrene, with about 0.10 moles of vinyl pyridine results in a ratio of X to Y of 0.90:0.10. The type of reactions involved are described in Polymer Handbook, 2nd Edition, J. Brandrup and E. H. Immergut, John Woley & Sons, New York, 1975, pages 11-57, and Free Radical Telomerization, C. M. Starks, Academic Press, New York, 1974, the disclosure of which is totally incorporated herein by reference.

The chain transfer agent employed in the preparation of the telomeric amines of the present invention is selected in accordance with the following equation:

$$\frac{[TX]}{[A]} = \frac{1}{\bar{T}} \quad \frac{[\pi^B X^2 + 2X + \pi^A]}{[\pi_B C_{BT} X + \pi_A C_{AT}]}$$

where [TX] = chain transfer agent concentration in moles.

where [A] and [B] = monomer concentration in moles.

where $\bar{T}$ = average degree of polymerization where X = [B]/[A]

where $\pi_A$ and $\pi_B$ are monomer reactivity ratios.

where $C_{AT}$ and $C_{BT}$ are chain transfer constants.

Among suitable chain transfer agents are carbon tetrachloride, iso-butyraldehyde, n-butyraldehyde, and the like, with n-butyraldehyde being preferred.

Also Z, the degree of polymerization, can be controlled by the proper choice and concentration of a suitable initiator such as benzoylperoxide and azo-bis-isobutyronitrile to produce oligomers having the desired molecular weight.

Illustrative examples of the telomeric amine charge enhancing additives embraced by the above-identified formula include telomeric and oligomeric copolymers such as styrene/4-vinylpyridine, styrene/2-vinylpyridine, styrene/3-vinylpyridine, styrene/dimethylaminoethylmethacrylate, styrene/t-butylaminoethylmethacrylate, n-butylmethacrylate/4-vinylpyridine, n-butylmethacrylate/2-vinylpyridine, n-butylmethacrylate/3-vinylpyridine, n-butylmethacrylate/dimethylaminoethylmethacrylate, n-butylmethacrylate/t-butylaminoethylmethacrylate, and the like. There may be substituted for the styrene and butyl acrylate segments, alkyl and halo substituted styrenes, acrylates, alkyl substituted methacrylates, while alkyl substituted vinylpyridines may be substituted for the vinyl pyridines. Typical alkyl substituents include methyl, ethyl, propyl, butyl, pentyl, hexyl, and the like.

The amount of telomeric amine added to the toner ranges from about 0.1 percent by weight to about 35 percent by weight and prepreferably from about 0.1 percent by weight to about 15 percent by weight. The amount of telomeric amine employed can be outside these ranges providing that such amounts accomplish the objectives of the present invention. The telomeric and/or oligomeric amine can be blended into the system or coated onto the pigment or colorant such as carbon black which is part of the developing composition.

Numerous methods may be employed to produce the toner of the present invention, one method involving melt blending the resin and the pigment coated with the telomeric amine compound, followed by mechanical attrition. Other methods include those well known in the art such as spray drying, melt dispersion, and dispersion polymerization. For example, a solvent dispersion of a resin, pigment and telomeric amine compound are spray dryed under controlled conditions, thereby resulting in the desired product. Such a toner prepared in this manner results in a positively charged toner in relationship to the carrier materials used, and these materials exhibit the improved properties such as rapid admix charging as mentioned herein.

While any suitable resin may be employed in the system of the present invention, typical of such resins are polyamides, epoxies, polyurethanes, vinyl resins and polyester especially those prepared from dicarboxylic acids and diols comprising diphenols. Any suitable vinyl resin may be employed in the toners of the present system, including homopolymers or copolymers of two or more vinyl monomers. Typical of such vinyl monomeric units include: styrene, p-chlorostyrene, vinyl naphthalene, ethylenically unsaturated mono-olefins such as ethylene, propylene, butylene, isobutylene and the like; vinyl halides such as vinyl chloride, vinyl bromide, vinyl fluoride, vinyl esters such as vinyl acetate, vinyl propionate, vinyl benzoate, vinyl butyrate and the like; esters of ethylinic aliphatic monocarboxylic acids such as methyl acrylate, ethyl acrylate, n-butylacrylate, isobutyl, acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidone and the like; and mixtures thereof.

Generally toner compositions containing a relatively high percentage of styrene are preferred. The styrene resin employed may be a homopolymer of styrene or styrene homologs or copolymers of styrene with other monomeric groups. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization techniques such as free radical, anionic, and cationic polymerization processes. Any of these vinyl resins may be blended with one or more resins if desired, preferably other vinyl resins, which insure good triboelectric properties and uniform resistance against physical degradation. However, nonvinyl type thermoplastic resins may also be employed including resin modified phenolformaldehyde resins, oil modified epoxy resins, polyurethane resins, cellulosic resins, polyether resins, and mixtures thereof.

Also esterification products of a dicarboxylic acid, and a diol comprising a diphenol may be used as a preferred toner resin material for the toner composition of the present invention. These materials are illustrated in U.S. Pat. No. 3,655,374 totally incorporated herein by reference. The diphenol reactant being of the formula as shown in column 4, beginning at line 5 of U.S. Pat. No. 3,655,374, and the dicarboxylic acid being of the formula as shown in column 6 of the same patent. The resin is present in an amount so that the total of all ingredients used in the toner total 100%, thus when 5% by weight of the telomeric amine compound is used, and 10% by weight of pigment or colorant such as carbon black, about 85% by weight of resin material is used.

Optimum electrophotographic resins are obtained with styrene butylmethacrylate copolymers, styrene vinyl toluene copolymers, styrene acrylate copolymers, polyester resins, predominantly styrene or polystyrene base resins as generally described in U.S. Pat. No. Re. 25,136 to Carlson, polystyrene blends as described in U.S. Pat. No. 2,788,288 to Rheinfrank and Jones, and styrene-butadiene resins.

Any suitable pigment or dye may be employed as the colorant for the toner particles, such materials being well known and including for example, carbon black, nigrosine dye, aniline blue, calco oil blue, chrome yellow, ultramarine blue, DuPont oil red. methylene blue chloride, phthalocyanine blue and mixtures thereof. The pigment or dye should be present in the toner in sufficient quantity to render it highly colored, so that it will form a clearly visible image on the recording member. For example, where conventional xerographic copies of documents are desired, the toner may comprise a black pigment, such as carbon black, or a black dye such as Amaplast black dye available from the National Aniline Products, Inc. Preferably, the pigment is employed in amounts of from about 3% to about 20% by weight based on the total weight of toner, however, if the colorant employed is a dye, substantially smaller quantities may be used.

Any suitable carrier material can be employed, providing such carrier particles are capable of triboelectrically obtaining a charge of opposite polarity to that of the toner particles. In the present invention in one embodiment that would be a negative polarity, so that the toner particles will adhere to and surround the carrier particles. Examples of suitable carrier materials include sodium chloride, ammonium chloride, potassium chloride, Rochelle salt, sodium nitrate, aluminum nitrate, potassium chlorate, granular zircon, granular silicon, methylmethacrylate, glass, steel, nickel, iron ferrites, silicon dioxide and the like, with metallic carriers especially magnetic carriers being preferred. The carriers can be used with or without a coating. The coatings generally contain fluorinated polymers such as polyvinyl fluoride resins, but other resins especially those which charge negatively, such as polystyrene, halogen containing ethylenes and the like can be used. Many of the typical carriers that can be used are described in U.S. Pat. Nos. 2,618,441; 2,638,522; 3,618,522; 3,591,503; 3,533,835; and 3,526,533. Also nickel berry carriers as described in U.S. Pat. Nos. 3,847,604 and 3,767,598 can be employed, these carriers being nodular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier particles may be employed with the toner composition in any suitable combination, however, best results are obtained when about 1 part toner is used, to about 10 to about 200 parts by weight of carrier.

The method of the present invention comprises forming a negative electrostatic latent images on an image bearing member, such as a photoreceptor, contained in an electrophotographic imaging system, contacting the image with the positively dry developer composition described herein, followed by subsequently transferring the developed latent image to a substrate, and permanently affixing the image thereto.

Developing compositions of the present invention may be used to develop electrostatic latent images on any suitable electrostatic surface capable of retaining charge including conventional photoconductors, however, the developers of the present invention are best utilized in systems wherein negative charges reside on the photoreceptor, and this usually occurs with organic photoreceptors, illustrative examples of such photoreceptors being polyvinyl carbazole, 4-dimethylaminobenzylidene, benzhydrazide; 2-benzylideneaminocarbazole, (2-nitro-benzylidene)-p-bromoaniline; 2,4-diphenyl-quinazoline; 1,2,4-triazine; 1,5-diphenyl-3-methyl pyrazoline, 2-(4'-dimethyl-amino phenyl)-benzoxazole; phthalocyanines and mixtures thereof.

By developer composition as used herein is meant toner particles, plus carrier particles, and charge enhancing additives with the toner particles being comprised of resin particles and a colorant or pigment such as carbon black.

The following examples further define the species of the present invention, however, these examples are intended to illustrate and not limit the scope of the present invention. Parts and percentages are by weight unless otherwise indicated, and Z represents the degree of polymerization wherein there results the materials of the molecular weights indicated.

EXAMPLE I

There was prepared the telomer styrene/4-vinylpyridine by heating together a mixture of 83.3 grams of purified styrene monomer, 21.0 grams of purified 4-vinylpyridine monomer, 243.5 grams of n-butyraldehyde monomer, and 2.1 grams of 2,2'-azo-bis-isobutyronitnile (AIBN) for 21 hours at 75° C. under an argon blanket. The monomers were purified before use by treatment with Basic Alumina Woelm B. The telomeric amine was isolated by precipitation into a large excess of isomeric hexanes (Fisher H291) (boiling range 65°-68° C.). The telomer was then purified by dissolving in chloroform, washed with a dilute aqueous sodium hydroxide solution, dried over a Linde Molecular Sieve No. 4A, and then precipitated by adding the telomer to a large excess of isomeric hexanes. The resulting product was then vacuum dried in an oven. There was isolated in a 70 percent yield, a styrene/4-vinylpyridine telomer of the formula

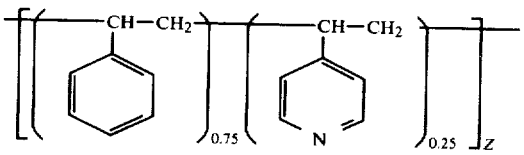

This telomer had a number average molecular weight of 2,500 and a weight average molecular weight of 5,100. The styrene mole fraction 0.75 and the 4-vinylpyridine mole fraction 0.25 were experimentally verified by elemental carbon/hydrogen/nitrogen analysis. Found: 88.78% C, 8.01% H, 3.35% N; Calc: 89.15% C, 7.5% H, 3.36% N.

EXAMPLE II

The procedure of Example I was repeated with the exception that the ratio of styrene monomer to 4-vinylpyridine monomer was adjusted in order to prepare a styrene/4vinylpyridine telomer having a styrene mole fraction of 0.96 and a 4-vinylpyridine mole fraction of 0.04. The resulting composition was found to have a number average molecular weight of 4,000, and a weight average molecular weight of 9,000.

EXAMPLE III

The procedure of Example I was repeated with the exception that 4-vinylpyridine monomer was polymerized in the absence of styrene monomer to prepare a 4-vinylpyridine telomer having a 4-vinylpyridine mole fraction of 1.0.

EXAMPLE IV

A toner composition was prepared by melt blending, followed by mechanical attrition of 2.3 parts of the styrene/4vinylpyridine telomer of Example I, with 6 parts of Regal 330 carbon black and 91.7 parts of a styrene/n-butylmethacrylate resin, 65 percent by weight of styrene, 35 percent by weight of n-butylmethacrylate.

EXAMPLE V

A toner was prepared by melt blending, followed by mechanical attrition of 0.29 parts of the styrene/4vinylpyridine telomer of Example I with 6 parts Regal 330 carbon black and 93.71 parts styrene/butylmethacrylate resin.

EXAMPLE VI

Two and one half (2.5) parts of the toner of Example IV and 97.5 parts of a carrier comprised of 0.175 percent Kynar 201, vinylidene fluoride resin available from Penwalt Corporation, coated on atomized steel carrier were blended into a developer. The developer was roll milled. After 10 minutes roll milling the triboelectric charge on the toner was measured, using a Faraday Cage, and found to be +67 uc/gram, (microcoulombs per gram).

This developer was tested in a fixture using a polyvinyl carbazole photoreceptor charged negatively, and good quality prints of excellent resolution were obtained.

EXAMPLE VII

Two and one half (2.5) parts of the toner of Example V and 97.5 parts of a carrier comprised of 0.175 percent Kynar 201, vinylidene fluoride resin available from Penwalt Corporation, coated on atomized steel carrier were blended into a developer. The developer was roll milled. After 10 minutes roll milling the triboelectric charge on the toner was measured, using a Faraday Cage, and found to be +37 uc/gram.

This developer was tested in a fixture using a polyvinylcarbazole photoreceptor charged negatively and good quality prints of excellent resolution were obtained.

EXAMPLE VIII

The procedure of Example I was repeated with the exception that a styrene/2-vinylpyridine telomer was prepared by employing a 2-vinylpyridine monomer in place of the 4-vinylpyridine monomer.

EXAMPLE IX

The procedure of Example I was repeated with the exception that a styrene/3-vinylpyridine telomer was prepared utilizing a 3-vinylpyridine m

EXAMPLE X

The telomers of Examples VIII and IX were formulated into developer compositions in accordance with Example VII and these developers compositions when used to develop images in a xerographic imaging system using a polyvinylcarbazole photoreceptor charged negatively, produced developed images of high quality and excellent resolution. Additionally, after about 10 minutes of roll mixing time, a triboelectric charge of +45 microcoulombs was determined employing a Faraday cage.

Toners and developers containing the telomeric charge enhancing additives of the present invention, rapidly charge new uncharged toner being added as replenishment material to the developer composition. This is known as rapid admix charging. By admix charging is meant providing the appropriate charges, for example, positive charges, at a rapid rate to new uncharged toner particles, replenishment toner being added to the toner which already contains charges thereon. As is customary in xerographic imaging systems, new toner must be added to the system as toner is being consumed for the development of images. In the past, a new uncharged toner being added did not obtain appropriate charge until a significant period of time had elapsed, for example, after 10 to 15 minutes. This adversely affected the developer package, and thus good high quality images would not result until the new uncharged toner particles had acquired electrical charges. In some instances, no images whatsoever could be developed until the uncharged toner was mixed with the charged toner in the machine system being utilized, which utually involves 10 to 15 minutes mixing time. When the telomeric amine charge enhancing additives of the present invention are used in the toner composition, the rate at which the uncharged toner acquires charge, such as positive charge, is substantially less than 10 minutes and typically such toner becomes suitably charged within from about 1 minute to about 3 minutes. Such rapid admix charging allows the developer system to become more stable over a shorter period of time as compared to prior art systems, therefore, better quality images are obtained with no background. This was a significant finding that was not appreciated by the prior art.

Other modifications of the present invention may occur to those skilled in the art upon a reading of the present disclosure and these are intended to be encompassed within the scope of the present invention.

What is claimed is:

1. A positively charged dry developer composition comprised of resin particles, pigment particles, carrier particles, and a telomeric amine charge enhancing additive of the formula:

$$[A_xB_y]_Z$$

wherein A is a segment that is soluble/dispersible in the resin particles, B is an amine segment, x and y are numbers representing mole fractions of A and B, the sum of x and y being equal to 1, and Z represents the degree of polymerization, wherein there results a telomeric amine having a number average molecular weight of from about 1,000 to about 10,000.

2. A positively charged dry developer composition in accordance with claim 1 wherein the ratio of x to y is 0.75:0.25, 0.96:0.04, 0.0:1.0, 9.0:1.0, or 9.8:0.2, 0.9:0.10, 0.98:002.

3. A positively charged developer composition in accordance with claim 1 wherein the resin is a styrene butylmethacrylate copolymer, or a styrene butadiene copolymer, the pigment is carbon black, and the carrier consists of a steel core coated a with vinylidene fluoride polymer.

4. A developer composition in accordance with claim 3 wherein the styrene butylmethacrylate is a styrene/n-butylmethacrylate, containing 65 percent by weight of styrene and 35 percent by weight of n-butylmethacrylate, and the styrene butadiene resin contains 90 percent by weight of styrene and 10 percent by weight of butadiene.

5. A positively charged developer composition in accordance with claim 1 wherein the telomeric amine is styrene/2-vinylpyridine.

6. A positively charged developer composition in accordance with claim 1 wherein the telomeric amine is a styrene/3-vinylpyridine.

7. A positively charged developer composition in accordance with claim 1 wherein the telomeric amine is styrene/4-vinylpyridine.

8. A method of imaging comprising forming a negative electrostatic image on a photoreceptor contained in an electrophotographic imaging system, contacting the image with the positively dry developer composition of claim 1, followed by subsequently transferring the developed latent image to a substrate and permanently affixing the image thereto.

9. A method of imaging in accordance with claim 8 wherein the ratio of x:y is 0.75:0.25, 0.96:0.04, 0.0:1.0, 0.90:1.10, or 0.98:0.02, the resin is a styrene/n-butylmethacrylate material, containing 58 percent by weight of styrene and 42 percent by weight of n-butylmethacrylate, or a styrene butadiene resin, containing 90 percent by weight of styrene and 10 percent by weight of butadiene, the colorant is carbon black, and the carrier consists of a steel core with a vinylidene fluoride polymer.

10. A method of imaging in accordance with claim 8 wherein the A segment is styrene and the B segment is a vinyl monomer.

11. A method of imaging in accordance with claim 8 wherein the telomeric amine is styrene/2-vinylpyridine.

12. A method of imaging in accordance with claim 8 wherein the telomeric amine is styrene/3-vinylpyridine.

13. A method of imaging in accordance with claim 8 wherein the telomeric amine is styrene/4-vinylpyridine.

14. A positively charged developer composition in accordance with claim 1 wherein the telomeric amine is present in an amount of from about 0.1 percent to about 15 percent.

15. A positively charged dry developer composition in accordance with claim 1 wherein the A segment is a vinyl monomer, an acrylate, or a methacrylate, and the B segment is an amine containing vinyl monomer, or amine acrylate or an amine methacrylate.

16. A positively charged dry developer composition in accordance with claim 15 wherein the vinyl monomer is selected from styrene or substituted styrenes, and the amine containing vinyl monomer is selected from vinylpyridine, or substituted vinylpyridines.

* * * * *